United States Patent [19]

Cerroni

[11] 4,067,506

[45] Jan. 10, 1978

[54] MACHINE FOR TEARING WASTE BAGS AND SEPARATING OUT PLASTIC FILM BAG MATERIAL

[76] Inventor: Manlio Cerroni, Via Bruxelles 53, Rome, Italy

[21] Appl. No.: 674,157

[22] Filed: Apr. 6, 1976

[30] Foreign Application Priority Data

Apr. 16, 1975 Italy ..... 49141/75

[51] Int. Cl.[2] ..... B02C 23/02

[52] U.S. Cl. ..... 241/200; 241/DIG. 38

[58] Field of Search ..... 241/200, DIG. 38

[56] References Cited

U.S. PATENT DOCUMENTS

| | | | |
|---|---|---|---|
| 2,005,758 | 6/1935 | Shiley | 241/200 |
| 2,711,834 | 6/1955 | Broberg et al. | 241/200 |
| 3,209,803 | 10/1965 | Feterl | 241/200 |
| 3,749,324 | 7/1973 | Hyde | 241/DIG. 38 |

FOREIGN PATENT DOCUMENTS

| | | | |
|---|---|---|---|
| 2,156,442 | 11/1971 | Germany | 241/200 |

*Primary Examiner*—Granville Y. Custer, Jr.
*Attorney, Agent, or Firm*—Toren, McGeady and Stanger

[57] ABSTRACT

A machine for tearing open small bags containing city solid waste material and for separating out plastic film material and/or the bags, includes an endless belt conveyor which carries on the surface thereof a plurality of aculei which engage bags containing waste material placed on the surface of the conveyor belt. The belt follows a path of a first straight or rectilineal length and a second or return straight or rectilineal length.The transition between the first straight length and the second straight length follows a mild curve about a drive pulley having a relatively large diameter, whereas the transition between the return straight length and the first straight length follows a relatively sharp curve about a drive pulley having a relatively small diameter so that such transition is sufficiently sudden additionally, a plurality of serrated blades are pivotally carried on a shaft above the belt conveyor so that the blades are placed in proximity to the surface of the belt for engaging and tearing the bag material carried thereon. Hook-like members having a hook portion bent in a direction opposite to the direction of travel of the belt may be substituted for the aculei members for engaging the bag material.

6 Claims, 5 Drawing Figures

MACHINE FOR TEARING WASTE BAGS AND SEPARATING OUT PLASTIC FILM BAG MATERIAL

BACKGROUND OF THE INVENTION

It is well known that in cities solid wastes are in an ever increasing amount, disposed of in bags formed from films of plastic. Also, users frequently are inclined to collect their solid waste in little bags, also of plastic materials, which in turn, are collected in larger bags also of plastic materials.

Machines for tearing open the layer bags that contain the little ones, are known, so that their contents may be easily displayed. No convenient way to tear open the small bags however, has been found until now. The opening of these little bags is important in order to divide their content, in such a way that it can be possible to feed the different products to their following use. Another problem encountered in handling solid waste of a city is the separation of the plastic films (i.e. plastic bags) from the paper, chiefly because the specific weight of these two materials is about the same. Furthermore, it should be noted that in the city solid wastes the paper waste is usually wet, which makes it more difficult to separate it from the plastic films and the rags.

It is an object of the present invention to provide a machine allowing the tearing of the little plastic bags containing city solid wastes and/or the separation of the plastic films and of the rags from the other wastes, that are present within the little bags.

In this connection, it is also to be noticed, that the machine of this invention is well suited for the selection of plastic films and not of the plastic containers having stiff walls that are previously separated by these wastes.

SUMMARY OF THE INVENTION

In accordance with the principles of the present invention, the city solid wastes, that were subjected to a first separation, for the elimination of the coarse materials and especially of the more bulky ones, that can be collected, are fed to a machine substantially comprising a belt conveyor provided with aculei or hooks, when using the machine to separate plastic films from bulky containers, and a series of toothed (serrated) blades placed in the path of travel of the belt conveyor. The main characteristic of the new machine is that the conveyor belt, as will be better understood from the following, travels first in a straight path, then follows a curve having a relatively large radius-and therefore extremely easy to follow, then travels in another straight path, in the opposite direction of the first one, and finally returns to the first straight path after going about a relatively sharp curve.

It is to be noted that if the belt conveyor is fitted with aculei, the little bags are caught by the said aculei and, as consequence of the progress of the belt conveyor, are carried under the aforementoned serrated blades and if they have a sufficient speed they are torn by the cooperative action of the blades and of the aculei. Therefore, after passing over the blades, the materials, released from their container are fed to a chute.

However, in the case, in which the said machine is also intended to perform the function of keeping apart the rags and the plastic films from the other materials, the aforementioned aculei are replaced with hooks having their length bent in the direction opposite to the progress of the belt conveyor and having the bent length upright relative to the plane of the belt conveyor. When the machine is operating on the plastic films, the said plastic films are laying down, in the path of the different moving hooks so that when the belt conveyor follows the relatively large curve, the plastic films will tend to be caught on the hooks, remaining suspended to these hooks for substantially the entire length of the return straight path to the sharp curve. When the belt reach a rear transmission roller having a small diameter, about which the belt follows a relatively sharp curve, the plastic films which are being carried on the hooks, as a consequence of the sharp movement of the belt, will fall off so as to be conveniently collected.

The invention will be better understand in connection with the description of some of its embodiments and by way of example to the attached drawing, in which:

DESCRIPTION OF THE INVENTION

Figure 1:
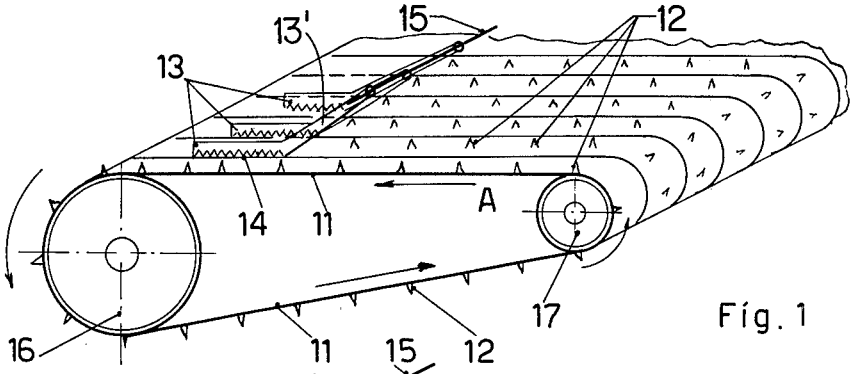
FIG. 1 shows, diagrammatically, the embodiment of the machine having the purpose of tearing the little plastic-bags.

With reference to the said drawing and more in particular to FIG. 1, the machine of the present invention, substantially comprises a belt conveyor 11 fitted with aculei 12 and a series of blades 13 provided in the direction of the plane of the belt 11. The blades are pivotally supported at the distal end of arms 13' from a shaft 15 in such a way as to engage the material carried by the belt 11 in response to their weight, but arranged also in such a way that they will be raised about shaft 15 if they encounter material which is too hard or bulky. In this way it is possible to eliminate damage to the belt and also to the blades.

A very important and essential feature of the machine in accordance wih the invention, is that the front transmission pulley; i.e. the pulley 16 has a diameter that is substantially larger than the rear pulley 17.

As previously stated, the difference between the diameter of the front pulley and the rear one, with respect to the direction of travel of the belt; following the arrow A, is significant not for the tearing of little bags is concerned, but for the other important workings of the machine.

Figure 2:
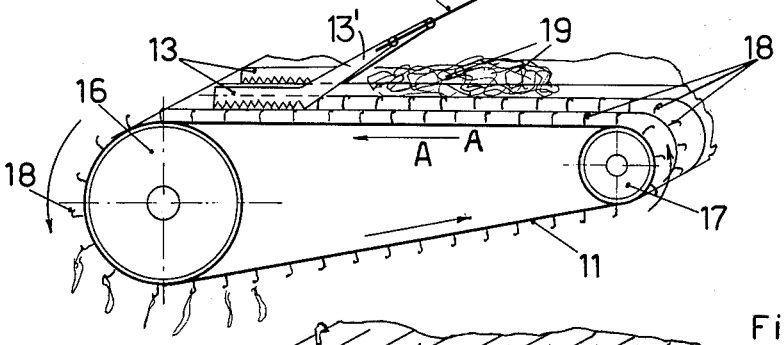
FIG. 2, shows, also diagrammatically an embodiment of the machine for tearing the little bags and for separating the plastic films from the other materials.

Indeed, if the machine is to function in a manner to separate the plastic films and the rags from the other materials, in addition to tearing the little bags it is necessary that the belt-conveyor reverses its progress-direction very gently. At the same time, as shown in FIG. 2, the aculei 12 of the embodiment in the FIG. 1 are substituted by hooks 18, the purpose of which will be shown and described hereinafter. It will be noted from FIG. 2, the hetereogeneous material composing the city solid wastes, designated with the numeral 19 in the said Figure, is caught by the hooks 18 and entrained under the blades 13. In such case, the hooks are working exactly in a way similar to that of the aculei 12.

It must be pointed out that the hooks 18 in the superior and rectilinear length of the belt 11, i.e. in the length where the belt is loaded with the material within the little bags and also with loose material, to be separated and where the little bags must be torn, the said hooks 18 are bent in the direction opposite to the progress of the belt.

When as a result of the progress of the belt in the direction A, the little bags are released under the blaades 13 and the material is loosened and emptied, the plastic films and the rags, because of their firmness tend to be wound around the shanks of the said hooks 18. As a result, when the belt reaches the inlet of the curve about the transmission pulley 16 the loosened material will fall off from the belt 11, but the plastic films and the rags remain wrapped about the shanks of the hooks 18. As aforementioned, the bolt 11 follows a curve having a relatively large radius and therefore the plastic films and the rags are not going to be released from the said hooks 18, remaining in this wound condition for approximately the entire return path of the belt 11. In any case, it is useful to have in mind that, in connection with the gradient of the return length, it would be possible that some plastic-films and/or rags fall off. However, where the plastic films and/or the rags hold surely to the shank of the hooks 18, they will remain untill the sudden change in the direction of the progress of the belt 11, at the time the belt passes over the transmission pulley 17 having the small diameter. At this moment, the belt suddenly charges the direction of its progress and the plastic films and/or the rags are released from the shank of the hooks 18, since the hooks are now in a position that will no longer allow the plastic films and/or the rags to remain wound on the shank of the hooks. At the same time, it is to be noticed that the hooks have reached their new position because of the sudden movement.

Figure 3:
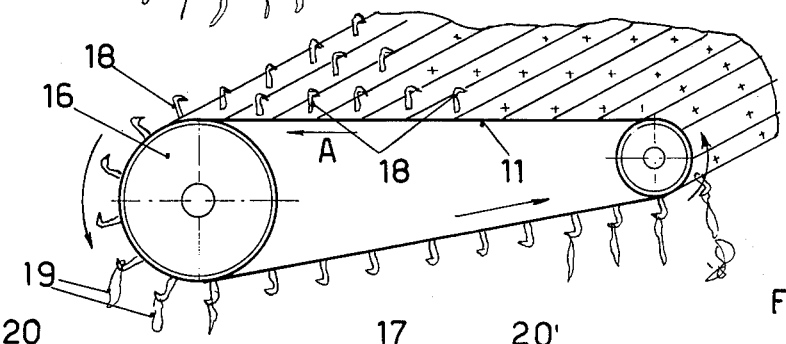
FIG. 3 shows the same machine working only as separator of the plastic from the re-maining materials.

Of course, as already noted, if the machine is to perform only as a separating device of plastic-films and/or rags from the other city solid materials which represent the bulk loaded on the belt-conveyor 11, it is possible, as shown in the FIG. 3, to leave out the part fitted with the blades 13. Therefore, only the hooks 18 will be on the belt-conveyor, which will take the plastic films and/or rags in such a way that the plastic films and/or rags present in the material on the belt conveyor, will be wound about the shanks of the hooks. The working of the machine in FIG. 3 is the same as for the machine shown in FIGS. 1 and 2 and previously described.

It should be noted that until now we have always spoken of a belt-conveyor, however the conveyor can be of any type provided it is suitable for maintaining the hooks 18 in their upright position as needed for the proper working of the machine. Therefore, in an other embodiment not shown and described, the belt conveyor 11 can be composed by a series of metal elements that are disposed transversally to the path of the belt, and which are each in touch with the other, and driven at their heads by chains running on guide-wheels 16 and 17 which also have the feature of a large difference in their diameters, with the front guide wheel always having a larger diameter than the rear one.

Figure 4:
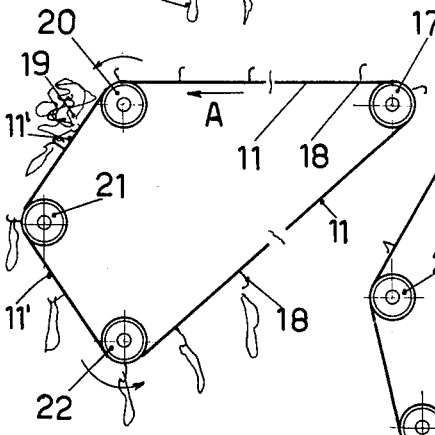
FIGS. 4 and 5 show other variations of the machine in its elementary embodiment.
Figure 5:
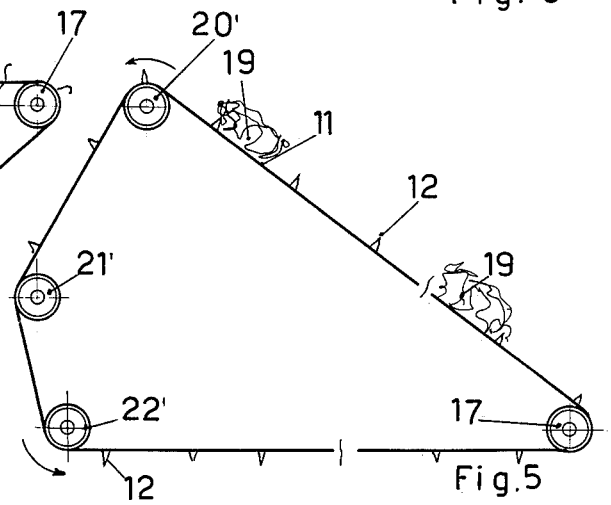

In the foregoing description and in the figures considered therewith, we have always spoken of transmission pulleys, or wheels, having different a diameter. However, as shown in FIGS. 4 and 5 the transmission pulleys can also have the same diameter, but in such a circumstance they must be placed in such a way that the path sloping downwards always has a very gentle bending, in such a way that the belt will not change its direction suddenly and, as consequence, the progress of the hooks 18 on the belt. Referring now to FIG. 4, the rear transmission pulley 17 is equal in diameter to the rear pulley shown in FIGS. 1 to 3, but the front pulley 16 is replaced by a series of smaller pulleys 20, 21 and 22, placed conveniently, for example, following the vertices of a triangle, in such a way that the sloping-down length of the belt 11 is subdivided in two lengths 11' and 21'', each having a path which departs from the superior path of the belt 11, but follows a mild angle.

Similarly, as seen in FIG. 5, the arrangement of the pulleys 20, 21 and 22 in FIG. 4 can be changed in such a way to change the path of the belt 11, using the rectilineal lengths between the pulleys 20', 21' and 22' in such a way to use the same for a useful function.

Of course, it is possible to conceive of many other different solutions for changing the path of the belt 11 and lead the same to the rectilinear path, but all these variations, which are within the technique and the practical use, are considered part of the present invention and are intended to be covered within the scope of the following claims.

I claim:

1. A machine for tearing open bags containing solid waste and for separating out plastic film material and rags, comprising an endless belt conveyor being driven so as to follow a path defined by a first rectilineal length in which said belt travels in a first direction, a second rectilineal length in which said belt travels in a direction opposite to that of said first rectilineal length, a first transition path located between said first and second rectilineal paths providing a relatively mild transition from said first rectilineal path to the second rectilineal path, a second transition path located between said second and first rectilineal paths providing a relatively sudden transition from said second to said first recilineal path, a plurality of projections carried on and extending from the outer surface of said belt conveyor for engaging bags of waste and other waste matter supported thereon, and means mounted in proximity to the surface of said belt conveyor supporting said waste material and bags along said first rectilineal path for selectively cooperating with said projections for tearing said bags of waste, and means cooperating with said projections for tearing said bags of waste comprising a plurality of blades having a serrated cutting edge directed toward said belt conveyor, said blades being mounted so as to be pivotally moved away from said conveyor belt when engaged by bulk material and matter having a hardness not tearable by said blades so that said blades may be pivoted away from said conveyor to allow passage of said non-tearable material avoiding damage to said blades and said conveyor.

2. The machine according to claim 1 wherein said projection comprises spike-like aculei extending from the surface of said belt conveyor.

3. The machine according to claim 1 wherein said first transition path providing said relatively mild transition between said first and second rectilineal paths comprises a curved path extending about a transmission pulley having a relatively large diameter, and said second transition path providing for said relatively sudden transition from said second to said first rectilineal paths comprises a curve extending about a transmission pulley having a relatively small diameter with respect to said transmission pulley defining said first transition path.

4. The machine according to claim 1 wherein said first transition path between said first and second rectilineal paths providing for said relatively mild transition comprises a plurality of straight paths formed by said belt conveyor extending over a plurality of pulleys.

5. The machine according to claim 1 wherein said belt conveyor comprises a pair of chains, a plurality of transmission rollers engaging said chains for driving the belt conveyor in the desired direction, and a plurality of metal staves extending between said chains thereby forming a carpet defining a surface of said belt conveyor, said projections being carried on each of said staves.

6. A machine for tearing open bags containing solid waste and for separating out plastic film material and rags, comprising an endless belt conveyor being driven so as to follow a path defined by a first rectilineal length in which said belt travels in a first direction, a second rectilineal length in which said belt travels in a direction opposite to that of said first rectilineal length, a first transition path located between said first and second rectilineal paths providing a relatively mild transition from said first rectilineal path to the second rectilineal path, a second transition path located between said second and first rectilineal paths providing a relatively sudden transition from said second to said first rectilineal path, a plurality of projections carried on and extending from the outer surface of said belt conveyor for engaging bags of waste and other waste matter supported thereon, said projections comprising hook-like projections extending from the surface of said belt conveyor having the ends thereof remote from said conveyor belt in a direction opposite to the direction of travel of said belt conveyor, and means mounted in proximity to the surface of said belt conveyor supporting said waste material and bags along said first rectilineal path for selectively cooperating with said projections for tearing said bags of waste.

* * * * *